US008744297B2

(12) United States Patent
Kishi

(10) Patent No.: US 8,744,297 B2
(45) Date of Patent: Jun. 3, 2014

(54) IMAGE FORMING APPARATUS

(75) Inventor: Takehiro Kishi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 215 days.

(21) Appl. No.: 13/096,835

(22) Filed: Apr. 28, 2011

(65) Prior Publication Data

US 2011/0280605 A1 Nov. 17, 2011

(30) Foreign Application Priority Data

May 17, 2010 (JP) ..... 2010-113564

(51) Int. Cl.
*G03G 15/00* (2006.01)

(52) U.S. Cl.
USPC ..... 399/74; 399/49

(58) Field of Classification Search
USPC ..... 399/49, 74, 301
See application file for complete search history.

(56) References Cited

U.S. PATENT DOCUMENTS

| | | | | |
|---|---|---|---|---|
| 5,083,161 | A * | 1/1992 | Borton et al. | 399/49 |
| 6,198,490 | B1 * | 3/2001 | Eom et al. | 347/116 |
| 6,462,821 | B1 * | 10/2002 | Borton et al. | 356/446 |
| 2005/0103972 | A1 * | 5/2005 | Milton et al. | 248/676 |

FOREIGN PATENT DOCUMENTS

JP 2004-309292 A 11/2004

* cited by examiner

*Primary Examiner* — David Gray
*Assistant Examiner* — Thomas Giampaolo, II
(74) *Attorney, Agent, or Firm* — Canon USA Inc. IP Division

(57) ABSTRACT

An image forming apparatus includes an image bearing member, a toner image forming unit, a sensor, and a control unit. The toner image forming unit is configured to form a toner image on the image bearing member. The sensor includes a light-emitting unit for emitting light, a light-receiving unit for receiving reflected light, an electrical circuit board in which the light-emitting unit is attached, and a frame supporting the electrical circuit board with the electrical circuit board bonded with three supporting portions. The sensor is configured to detect the toner image formed on the image bearing member. The control unit is configured to control a toner image forming condition of the toner image forming unit according to an output of the sensor.

14 Claims, 16 Drawing Sheets

IMAGE FORMING APPARATUS

BACKGROUND OF THE INVENTION

1. Field of the Invention

The present invention relates to an image forming apparatus, such as a copying machine, a printer, a facsimile apparatus, or a multifunction peripheral. Further, the present invention relates to a configuration of an image forming apparatus including an optical sensor for optically detecting a toner image formed on an image bearing member.

2. Description of the Related Art

A conventional electrophotographic image forming apparatus forms toner images on photosensitive drums (image bearing members), transfers each toner image on an intermediate transfer member (a belt member or an image bearing member) to overlay the toner images, transfers the toner images onto a recording material conveyed, and fixes the toner images on the recording material. Such an image forming apparatus includes an optical sensor that detects misregistration of toner images (hereinafter referred to as toner patches). The optical sensor is typically located opposite a surface of the intermediate transfer member.

The optical sensor typically includes a light-emitting element, a light-receiving element, electrical circuit boards for driving each element, a lens, and a sensor frame.

Examples of optical sensors include a specular reflection type sensor 300 as illustrated in FIG. 10 and a diffuse reflection type sensor 400 as illustrated in FIG. 11. The specular reflection type sensor 300 detects specular reflected light. The diffuse reflection type sensor 400 detects diffused light. In the specular reflection type sensor 300, light emitted from a light-emitting element 31 is condensed via a lens 32. The condensed light is reflected by the surface of an intermediate transfer member 35. The reflected light is condensed onto a light-receiving element 34 via a lens 33. The light-receiving element 34 receives the condensed light and produces a detection signal (e.g., voltage signal) indicative of intensities of the condensed light received therein. The specular reflection type sensor 300 detects a misregistration of a plurality of toner patches based on a change of detection voltages generated in the light-receiving element 34. The specular reflection type sensor 300 is used in a case where the amount of light incident on the surface of the intermediate transfer member 35 is relatively large and the amount of light reflected by the intermediate transfer member 35 is sufficiently large compared with the amount of light reflected on the toner patches to be read (see FIG. 12).

On the other hand, the diffuse reflection type sensor 400 works in a manner similar to the above-described specular reflection type sensor 300, but it is selected in a case where the amount of light incident on the surface of the intermediate transfer member is relatively small and the amount of light reflected on the toner patches to be read is larger than the amount of light reflected from the surface of the intermediate transfer member (see FIG. 13). However, in the diffuse reflection type sensor 400, since output signals of the color toner patches of magenta (M), yellow (Y), and cyan (C) are opposite in signal level to an output signal of the black toner patch (Bk), the center of gravity of a color region cannot be calculated based on a constant output signal. Therefore, it is necessary to superpose other color toner patches on the black toner patch to express edge portions of the black toner patch.

In any one of the above-described optical sensors, the following method may be adopted for attaching the sensor inside an sensor frame. As discussed in Japanese Patent Application Laid-Open No. 2004-309292, generally, a light-emitting element and a light-receiving element of the lead type, or an electrical circuit board including a light-emitting element and a light-receiving element (a light-emitting unit and a light-receiving unit), are fixed at a predetermined position inside a sensor frame via a solder so as to cause an angle of emission of the light-emitting element and an angle of incidence of the light-receiving element to be within a predetermined range.

In the case where the light-emitting unit attached to the sensor frame is used, an technician (operator) determines a position of the electrical circuit board relative to the sensor frame while adjusting an inclination of an optical axis of the light-emitting element, and then fixes the electrical circuit board to the sensor frame using a fixing tool such as a screw. However, in such an operation, the fixing tool presses the electric circuit board and generates a force that distorts the shape of the electrical circuit board, which in turn changes the parallelism of the electrical circuit board. As a result, the light-emitting optical axis (dark arrow in FIG. 14) inclines with respect to a fixing plane as illustrated in FIG. 14, so that an illuminance distribution becomes irregular as illustrated in FIG. 14, thus decreasing reading accuracy.

Since the inclination of the optical axis of the light-emitting element greatly affects the reading accuracy, it is desirable that the amount of the inclination be limited to a minimum or entirely avoided. More specifically, when the optical axis inclines, a signal of the toner patch read by the light-receiving unit is distorted, for example, as illustrated in FIG. 15B. As a result, in a case where the position of the center of gravity of the read signal is set to be a position of the toner patch, the sensor may detect as if each color exhibits a relative misregistration (hereinafter referred to as a color misregistration). For example, FIG. 15B illustrates a case where the position of center of gravity for each color is shifted by an amount that would result in color misregistration. If the misregistration is corrected based on a different value from the actual color misregistration, the color misregistration may be increased.

Further, in the case of a sensor for detecting the density of a toner image, other than the sensor for detecting the relative misregistration, the inclination of the optical axis may cause an obstruction in improvement of the accuracy of density detection.

Therefore, when an image forming apparatus uses a sensor for optically detecting a toner image, it is highly desirable to minimize or eliminate the inclination of the optical axis of a light-emitting element attached in the sensor.

SUMMARY OF THE INVENTION

According to an aspect of the present invention, an image forming apparatus includes an image bearing member, a toner image forming unit, a sensor, and a control unit. The toner image forming unit is configured to form a toner image on the image bearing member. The sensor includes a light-emitting unit for emitting light, a light-receiving unit for receiving reflected light, an electrical circuit board in which the light-emitting unit is attached, and a frame supporting the electrical circuit board with the electrical circuit board bonded with three supporting portions. The sensor is configured to detect the toner image formed on the image bearing member. The control unit is configured to control a toner image forming condition of the toner image forming unit according to an output of the sensor.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
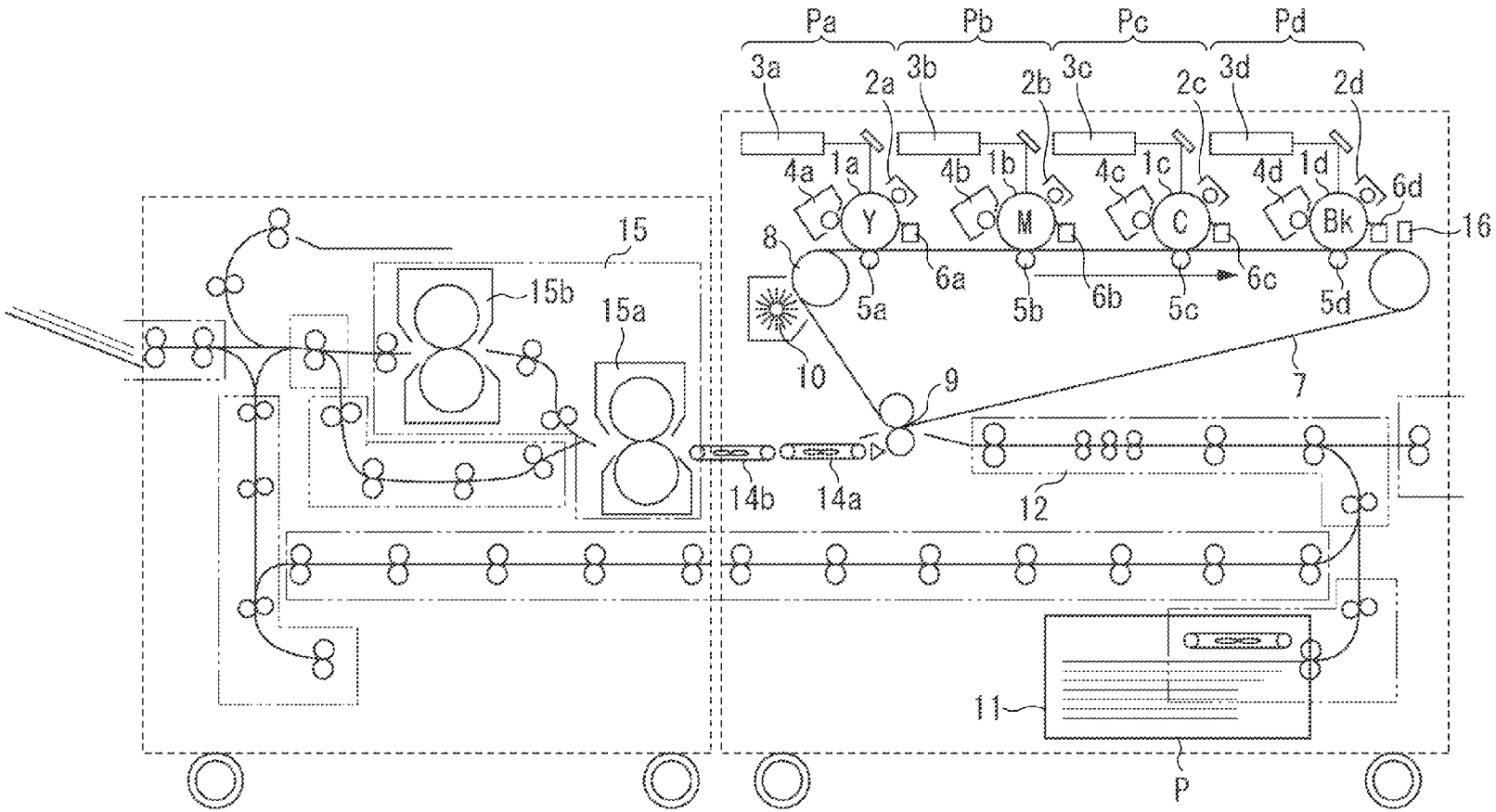
FIG. 1 is a schematic cross-sectional view of a tandem color printer, which is an example of an image forming apparatus according to an exemplary embodiment of the present invention.

A color image forming apparatus according to an exemplary embodiment of the present invention will be described below with reference to FIG. 1. In the present exemplary embodiment, the color image forming apparatus includes four image forming stations (image forming units) Pa, Pb, Pc, and Pd. In the present exemplary embodiment, the image forming station functions as a toner image forming unit. The image forming station Pa is an image forming unit configured to form a toner image using yellow (Y) toner. The image forming stations Pb, Pc, and Pd are image forming units configured to respectively form toner images using magenta (M) toner, cyan (C) toner, and black (Bk) toner, respectively. In each of the image forming stations Pa to Pd, rotatable photosensitive drums 1*a*, 1*b*, 1*c*, and 1*d*, which are image bearing members, are located, respectively. Around the photosensitive drums 1*a* to 1*d*, charging devices 2*a*, 2*b*, 2*c*, and 2*d*, exposure devices 3*a*, 3*b*, 3*c*, and 3*d*, developing devices 4*a*, 4*b*, 4*c*, and 4*d*, primary transfer devices 5*a*, 5*b*, 5*c*, and 5*d*, and cleaning units 6*a*, 6*b*, 6*c*, and 6*d* are located, respectively, along a rotation direction of each drum. Each exposure device includes a laser, which is controlled to emit laser beams according to an image signal, and a plurality of mirror portions (not illustrated), which guides the laser beams onto the drums. Writing timing of an image can be controlled by controlling the light emission timing of the laser and the mirrors.

At a lower side of the photosensitive drums 1*a* to 1*d*, an intermediate transfer belt 7, which is an endless flat-shaped belt member, is located. In the present exemplary embodiment, the intermediate transfer belt 7 bears a toner image and has a function as an image bearing member. The toner images formed in each of the image forming stations Pa, Pb, Pc and Pd are transferred to the intermediate transfer belt 7, so that a color image is formed on the intermediate transfer belt 7. The intermediate transfer belt 7 is supported and rotated by a plurality of rollers. For example, in the illustration of FIG. 1, the intermediate transfer belt 7 receives driving force from a drive roller 8, which is a drive transmission member, to rotate and move.

Further, a secondary transfer unit 9 transfers the toner image from the intermediate transfer belt 7 to a recording material P. The recording material P is fed from a sheet feed unit provided in a repository 11 and adjusted in its orientation at a registration adjustment unit 12. Thereafter, the toner image formed on the intermediate transfer belt 7 is transferred onto the conveyed recording material P at the secondary transfer unit 9. Further an intermediate transfer cleaning unit 10 collects toner that is not transferred in the secondary transfer unit 9 and remains on the surface of the intermediate transfer belt 7.

The recording material P which receives the toner image transferred thereto is conveyed on an upstream conveyance belt 14*a* and a downstream conveyance belt 14*b*, which are divided in up and down streams. A drive motor (not illustrated) drives the conveyance belts (14*a* and 14*b*). In these conveyance belts, a suction fan (not shown) is provided for suctioning the recording material P towards these belts. Thereafter, the recording material P is conveyed to a fixing unit 15, located on the downstream of the downstream conveyance belt 14*b*, and is heated, pressed, and fixed there, so that a multicolor (full color) image is obtained on the recording material P. In the present exemplary embodiment, the fixing unit 15 has a configuration including a plurality of fixing devices, i.e., a fixing device 15*a* and a fixing device 15*b*. However, the fixing unit 15 is not limited to the configuration in the present exemplary embodiment.

In such an image forming apparatus, if each of the photosensitive drums 1*a* to 1*d* rotates at an equal speed and there is not a speed change of the intermediate transfer belt 7, since magnifications of images developed by each color are the same, the misregistration of each color does not occur when start positions of writing are the same. However, it is difficult to exactly match each interval between the image forming stations Pa to Pd, so that a relative misregistration of each color may occur. A phenomenon due to the relative misregistration of each color becomes color misregistration.

In addition to this, there are other causes for color misregistration. For example, if the intermediate transfer belt 7 moves with uneven speed, the magnifications of toner images transferred in each primary transfer units 5*a*, 5*b*, 5*c* and 5*d* change, so that the color misregistration may occur.

In order to minimize or eliminate color misregistration, the image forming apparatus of the present exemplary embodiment takes a configuration which reduces change in speed of a rotation body relating to image formation.

Figure 15A:
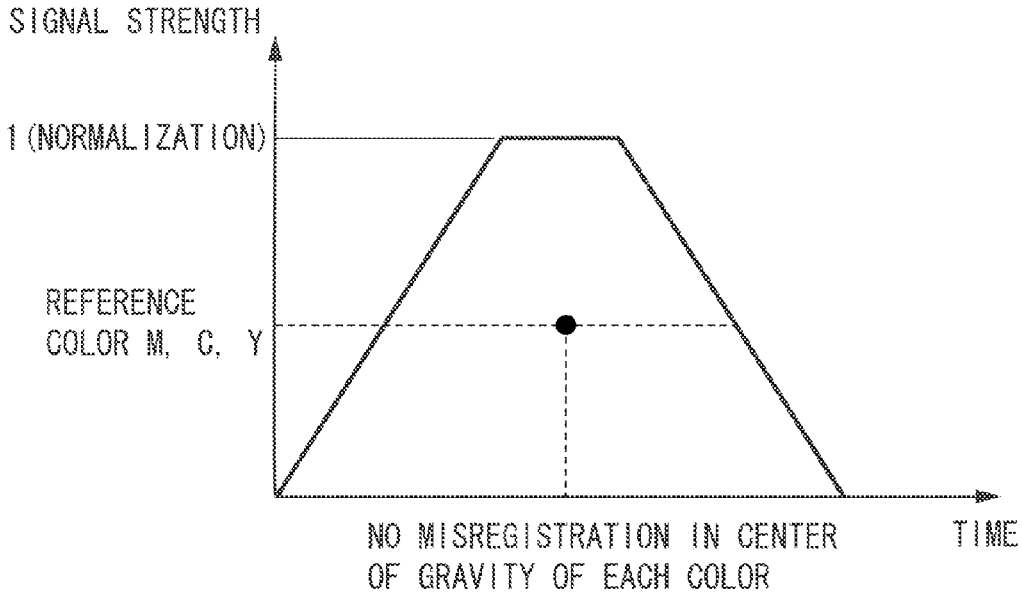
FIG. 15A illustrates a schematic waveform of a signal without misregistration detected by the light-receiving element of the sensor according to the present invention.
Figure 15B:
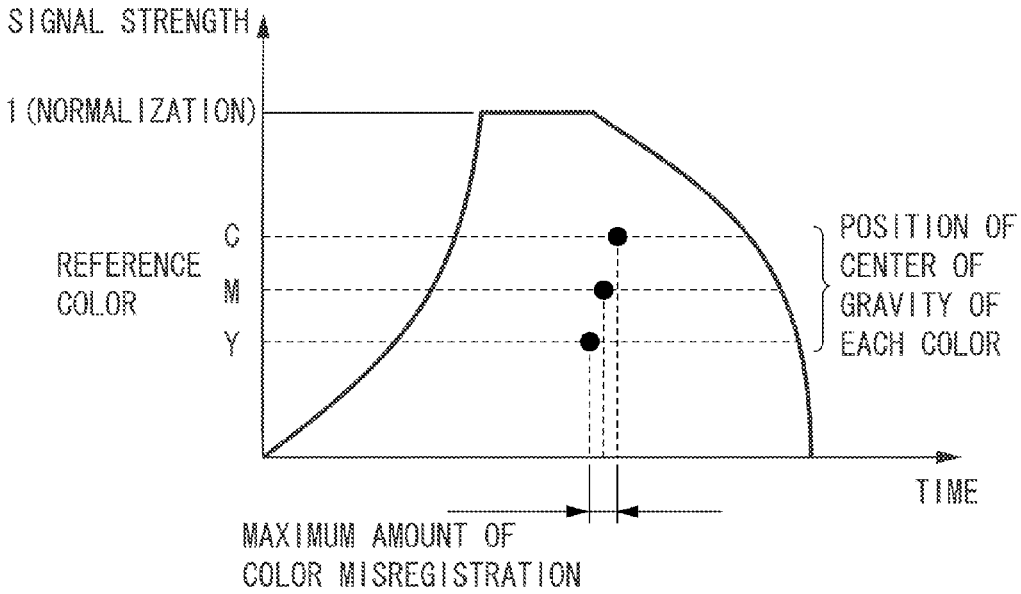
FIG. 15B illustrated that of a color misregistration conceptual view when an illuminance distribution is uneven.

On the other hand, as described above, even if the changing factor of portions relating to the image formation is caused to be small, there is a case in which the start position of image writing is shifted. In such a case, exposure timing of each of exposure units 3*a*, 3*b*, 3*c*, and 3*d* need to be corrected. For correcting the exposure timing, an actual amount of color misregistration is measured (see FIG. 15B) and the amount of the misregistration needs to be corrected. Accordingly, a registration patch detection sensor unit 16 is located at a position on the downstream side of the most downstream image forming station Pd and the upstream side of the secondary transfer unit 9. Furthermore, to detect the amount of color misregistration at a front side (one side) and a back side (another side) of the intermediate transfer belt 7 in a width direction orthogonal to the rotation direction of the intermediate transfer belt 7, registration patch detection sensors 50 (shown in FIG. 7) are provided at the front side and the back side.

In the present exemplary embodiment, the image forming apparatus includes a control unit (central processing unit (CPU)) for controlling a toner image forming condition according to an output of the registration patch detection sensors 50. As the toner image forming condition, the control unit adjusts the exposure time of each image forming station to decrease the amount of color misregistration. In addition, as for the toner image forming condition other than the adjustment of the exposure timing, there can be a configuration for adjusting the speed of the intermediate transfer belt 7 or a configuration for adjusting the speed of the photosensitive drums 1*a* to 1*d*.

Figure 7:
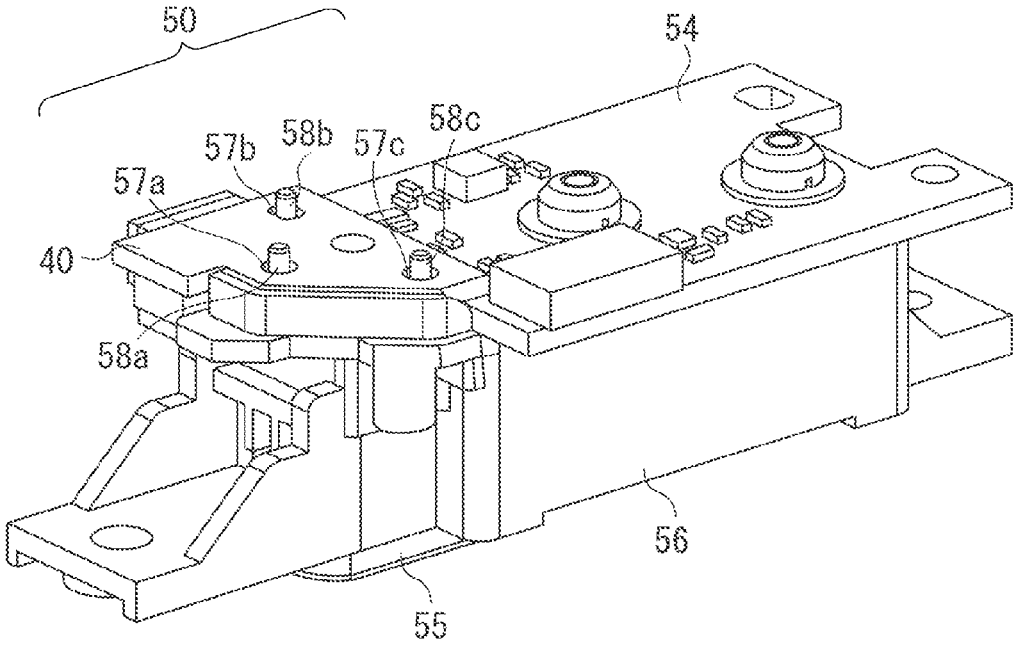
FIG. 7 is an outline schematic view of the optical sensor according to an exemplary embodiment of the present invention.

As illustrated in FIG. 7, the registration patch detection sensor 50 includes a sensor frame 56, an LED board 40, an electrical circuit board (PD board) 54 having a light-receiving unit, and a lens 55.

Figure 13:
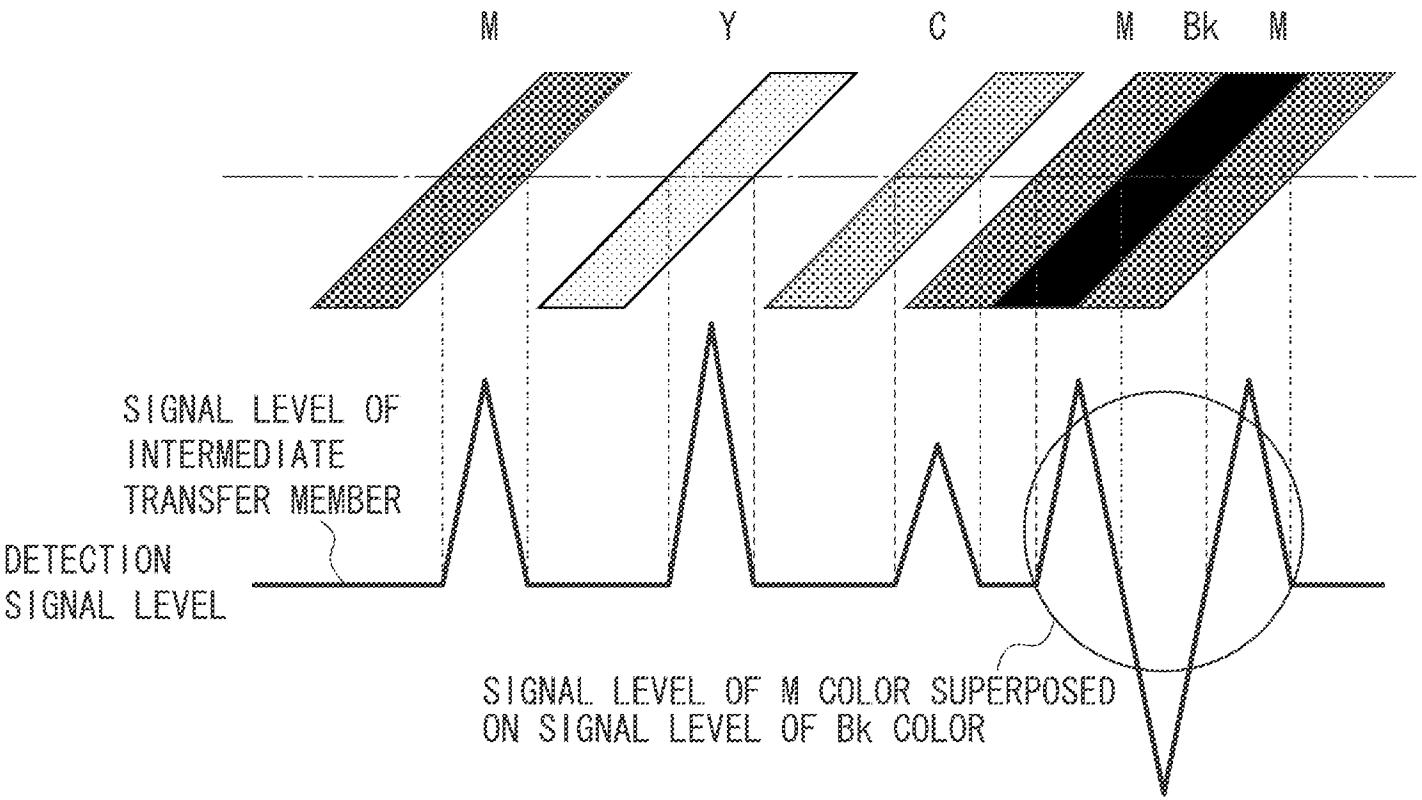
FIG. 13 illustrates an example of patches read by the diffused reflection sensor and a read waveform.
Figure 14:
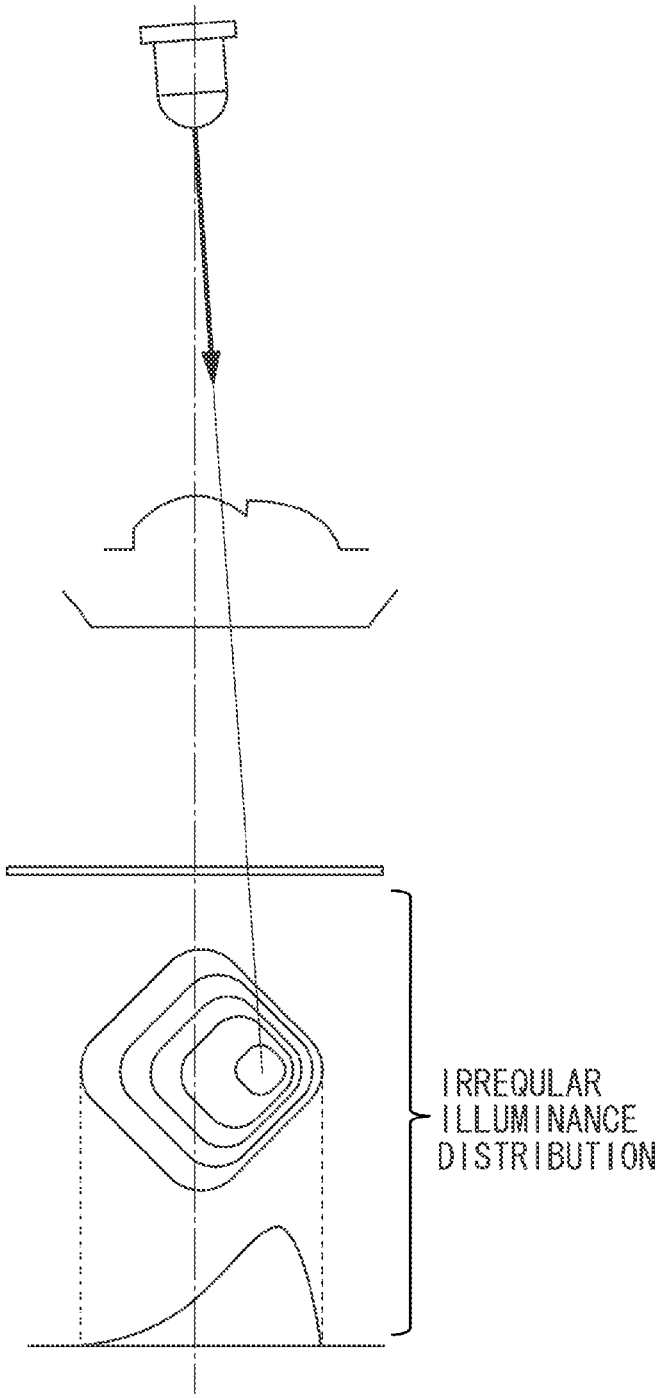
FIG. 14 is a schematic illuminance distribution view when the LED is mounted aslant to the sensor holder.

A toner patch to be read can have a shape pattern as illustrated in FIG. 13. That is, the toner patch to be read may include a pattern of M, Y, C and Bk colors, where certain colors can be superposed with other colors. In the present exemplary embodiment, the registration patch detection sensor 50 detects the amount of misregistration between the position of the center of gravity of a magenta patch, which is a reference color, and the position of the center of gravity of a toner patch of each color. Then, writing timing of an image is changed in such a manner as to correct the detected amount of misregistration via the exposure units. The shape pattern of the toner patch detected by the registration patch detection sensors 50 in the present exemplary embodiment is not limited to the illustrated shape.

Figure 2:
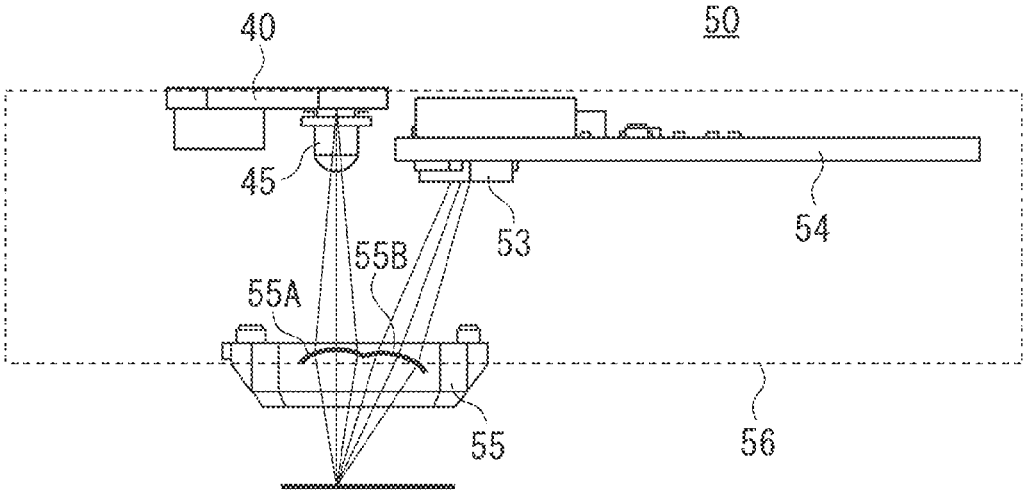
FIG. 2 is a schematic layout view illustrating an inner configuration of an optical sensor according to an exemplary embodiment of the present invention.

FIG. 2 illustrates an inner location configuration of one registration patch detection sensor 50. In the present exemplary embodiment, the registration patch detection sensor 50 is a diffuse reflection type sensor. The registration patch detection sensor 50, which is a one light-emitting and one light-receiving type, includes an LED board 40 (electrical circuit board), a photo-detector (PD) board 54 (electrical circuit board), a lens 55 for collecting light, and a sensor frame 56 for fixing and supporting those. An LED light-emitting unit 45, which is a light-emitting unit, is mounted on the surface of the LED board 40. A photo integrated circuit (IC) 53, which is a light-receiving element, is mounted on the surface of the PD board 54.

Figure 8:
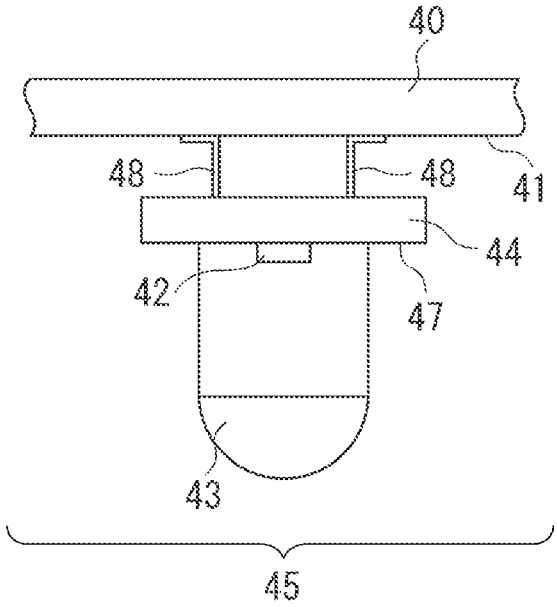
FIG. 8 is an outline schematic view of an LED light-emitting unit according to an exemplary embodiment of the present invention.

The LED light-emitting unit 45 is described below. As illustrated in FIG. 8, a bullet-shaped LED can be roughly divided into an LED chip 42, a cap lens 43, a mounting portion 44, and an electrode portion 48. The cap lens 43 seals the LED chip 42 so as to increase directivity of light. The LED chip 42 is a light-emitting element and mounted on the mounting portion 44. The electrode portion 48 is solder-bonded to a board surface 41 of the LED board 40. The mounting portion 44 is a supporting substrate supporting the light-emitting element.

As an LED element, the LED element capable of emitting infrared light having a peak wavelength of about 870 nm is used. The wavelength in the present case is determined by spectral characteristics of the toner patch to be read, and is not particularly limited. The registration patch detection sensor 50 uses the photo IC as a light-receiving element, but it can use a photo diode.

The lens 55 is made from a transparent resin material. The lens 55 includes a lens 55A and a lens 55B. The lens 55A collects light emitted from the LED light-emitting unit 45. The lens 55B collects light reflected from the surface of the intermediate transfer belt 7. A method of attaching the lens 55 to the sensor frame 56 includes fitting a protrusion for positioning provided at the lens 55 into a hole for positioning provided at the sensor frame 56, and fixing the lens 55 to the sensor frame 56 via an ultraviolet (UV) curing adhesive. Although the method for positioning the lens 55 and the type of the adhesive are described above, any other methods can be used if the lens can be fixed with high accuracy, so that the configuration is not particularly limited.

Figure 6:
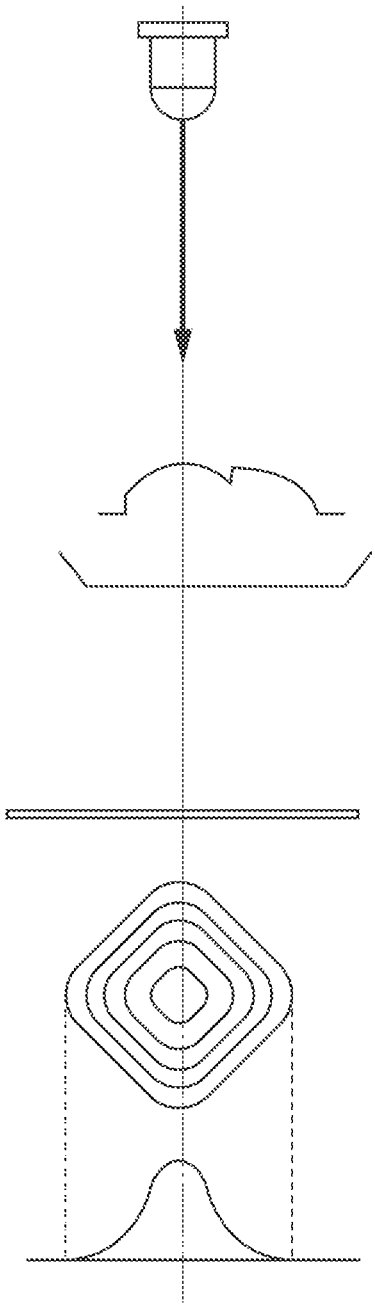
FIG. 6 is a schematic illuminance distribution view of light emitted from an LED.

In the registration patch detection sensor 50, a bullet-shaped LED is mainly used to obtain high directivity and a large amount of light. As illustrated in FIG. 6, the illuminance distribution of light emitted from the LED becomes a concentric shape around an optical axis. Thus, the illuminance distribution in FIG. 6 is on a surface orthogonal to the optical axis. When a light-emitting direction inclines relative to the surface of the intermediate transfer belt 7, the illuminance distribution on the intermediate transfer belt 7 becomes not concentric. The illuminance distribution can be corrected by using the lens 55A even when light is emitted aslant to the surface of the intermediate transfer belt 7 and. However, the reading accuracy decreases with respect to the variation in the vertical direction (the depth direction) to the intermediate transfer belt 7. Therefore, it is desirable that the mounting surface 47, in which the LED 42 in FIG. 8 is mounted, is parallel to the surface of the intermediate transfer belt 7, which is an illumination target. Thus, the image forming apparatus desirably has a configuration in which the optical axis is substantially orthogonal to a surface illuminated by light.

Figure 9:
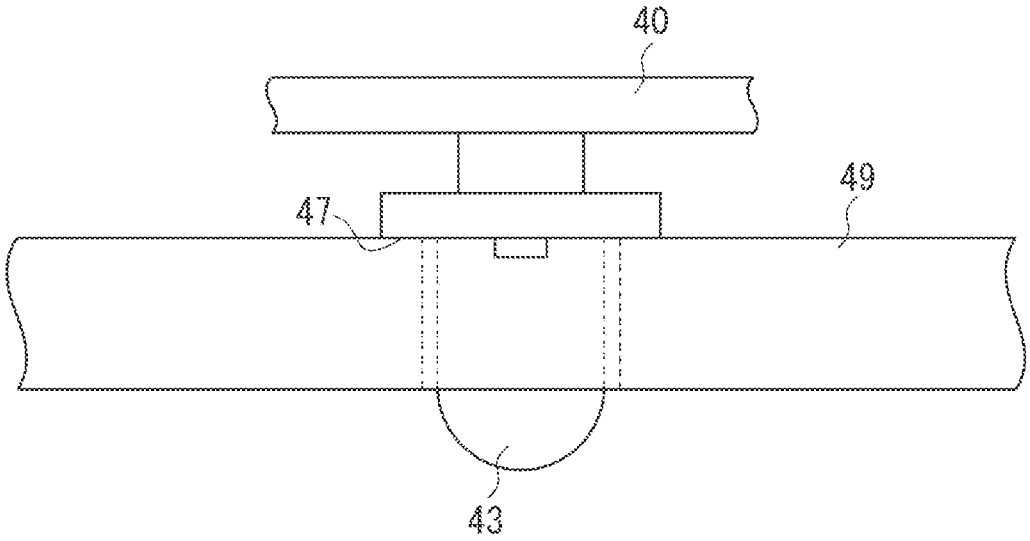
FIG. 9 is an outline schematic view of an LED light-emitting unit according to an exemplary embodiment of the present invention when the LED light-emitting unit is attached to the sensor frame.
Figure 10:
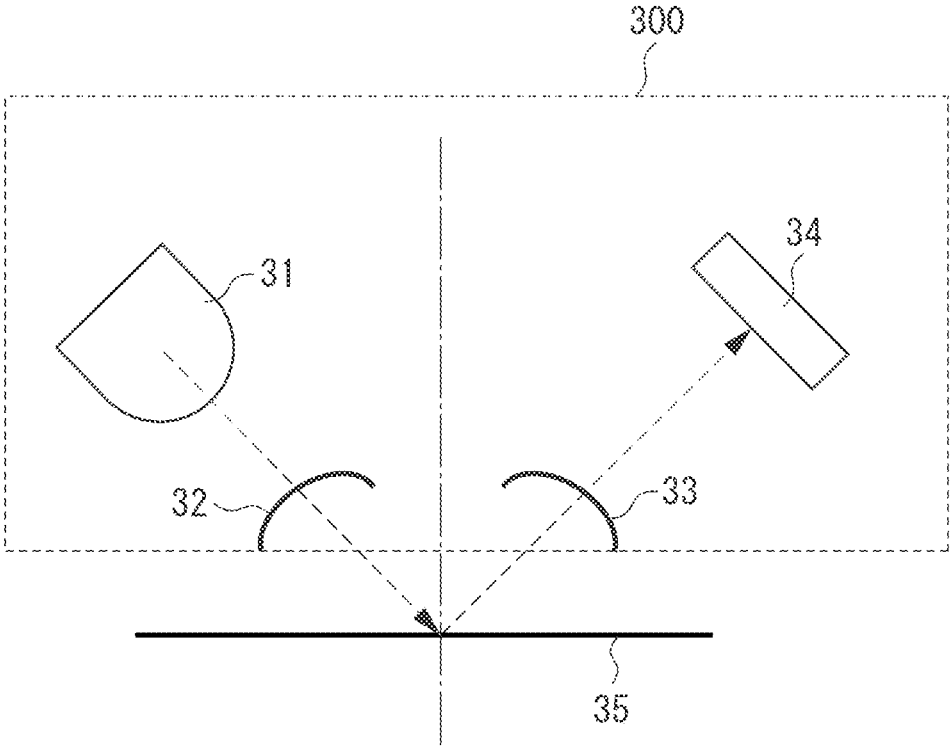
FIG. 10 is a schematic cross-sectional view of a specular reflection type sensor, which detects specular reflection light.
Figure 11:
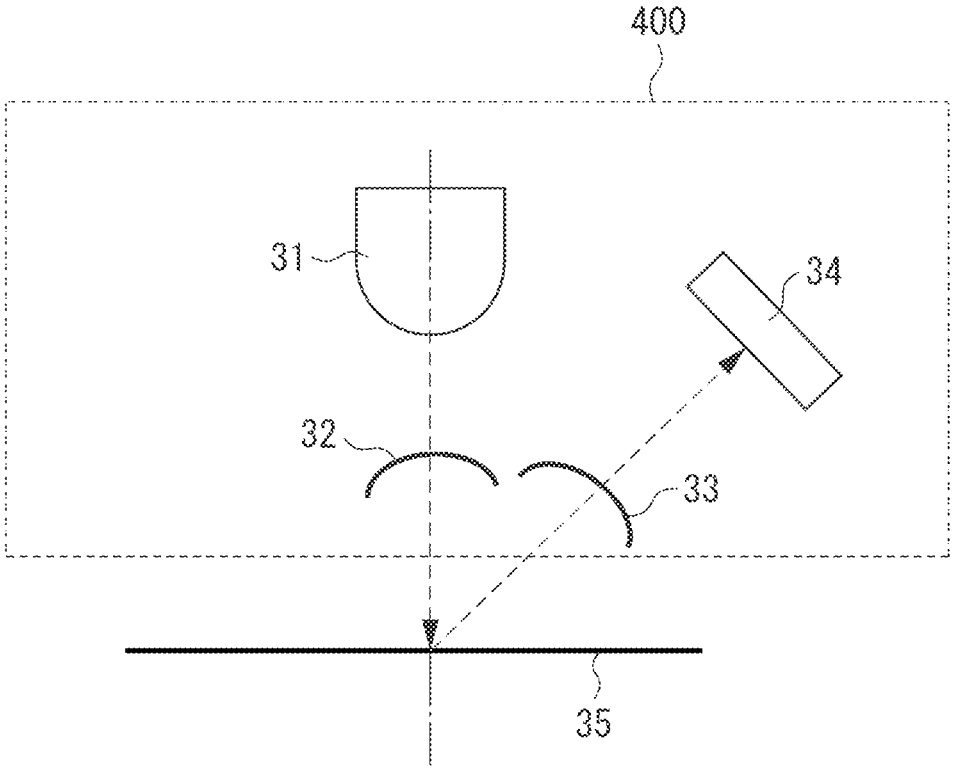
FIG. 11 is a schematic cross-sectional view of a diffused reflection type sensor, which detects diffused reflection light.
Figure 12:
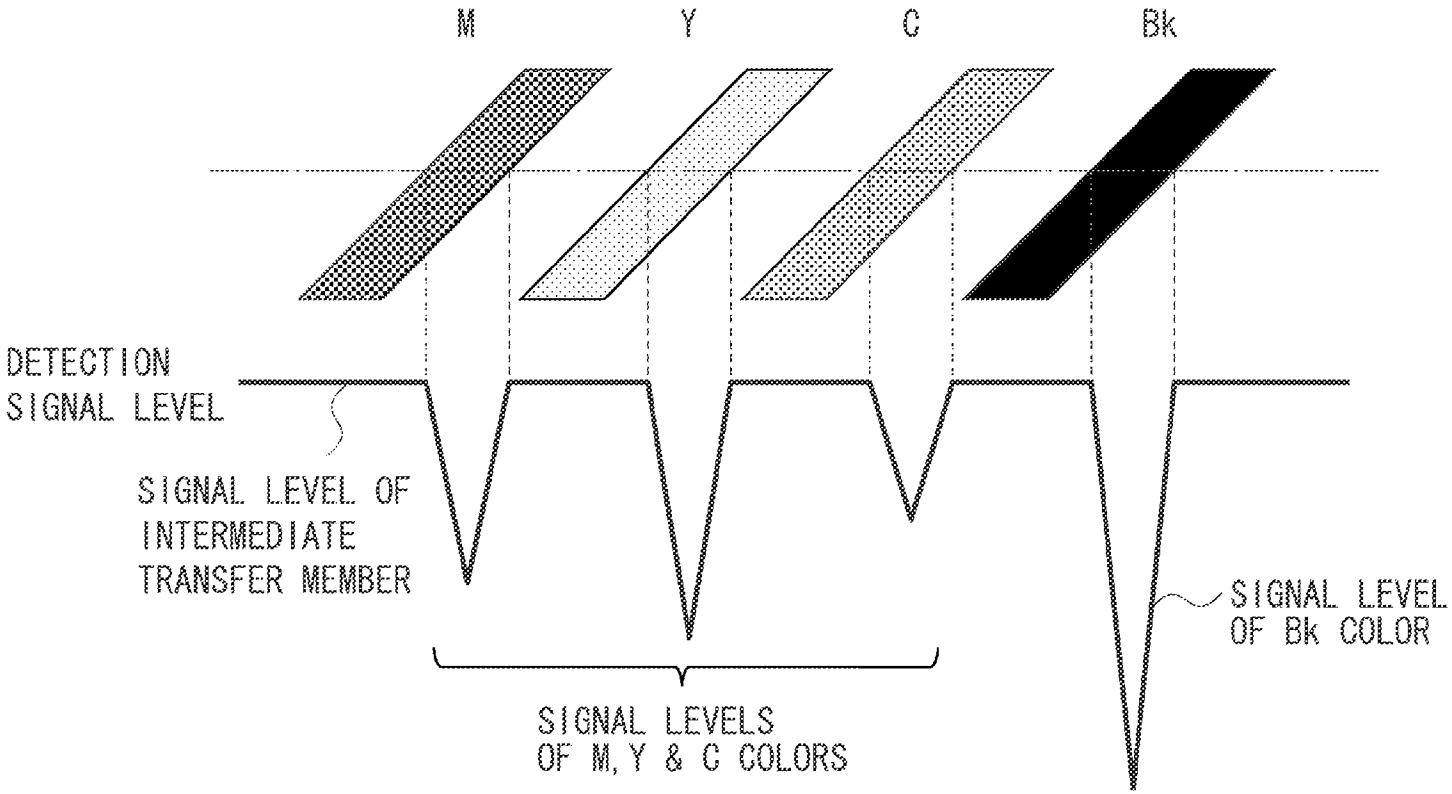
FIG. 12 illustrates an example of patches read by the specular reflection type sensor and a read waveform.

In the present exemplary embodiment, based on the mounting surface 47 in which the LED chip 42 is mounted, the LED board 40 needs to be positioned relative to the sensor frame 56 such that the surface of the intermediate transfer belt 7 is substantially parallel to the mounting surface 47. In the present exemplary embodiment, the size of the mounting surface 47 as viewed in the optical axis direction is larger than the size of the cap lens 43. Thus, in the present exemplary embodiment, as illustrated in FIG. 9, an abutting surface 49 for abutting against the mounting surface 47 is provided on the sensor frame 56, so that the mounting surface 47 abuts on the abutting surface 49. With this configuration, parallelism of the mounting surface 47 can be easily established, and positioning of the LED light-emitting unit 45 relative to the sensor frame 56 is performed without complications. In addition, the positioning portion on the mounting surface 47 having the abutting surface 49 has a cylindrical shape having a hole in which the cap lens 43 is inserted.

Although the LED light-emitting unit 45 is already mounted on the surface of the LED board 40, there are no certainties that the mounting surface 47 having the LED chip 42 thereon and the board surface 41 can be mounted in parallel. Therefore, the LED board 40 is bonded and fixed to the sensor frame 56 via an adhesive.

Figure 3:
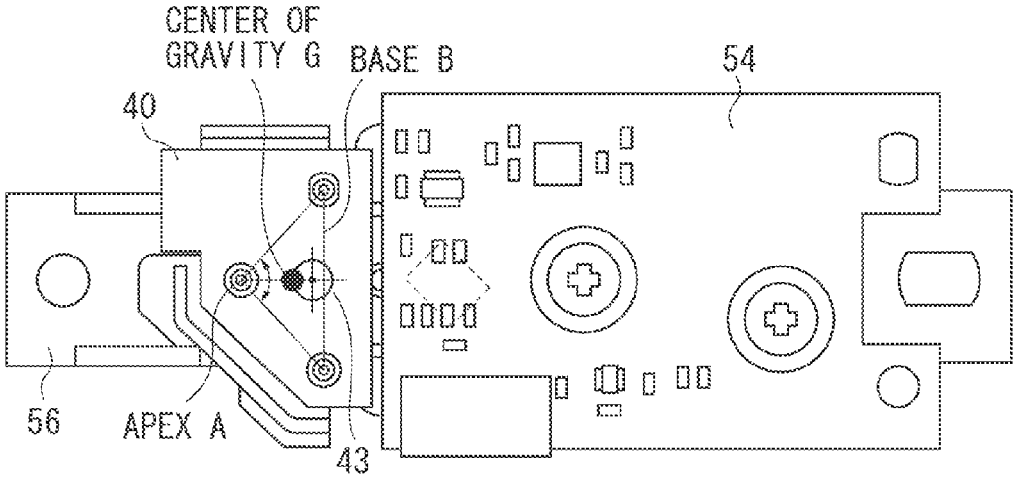
FIG. 3 is a state view in which a light-emitting diode (LED) board (LED board) and a photo diode (PD) board (PD board) are attached to a sensor holder.
Figure 4:
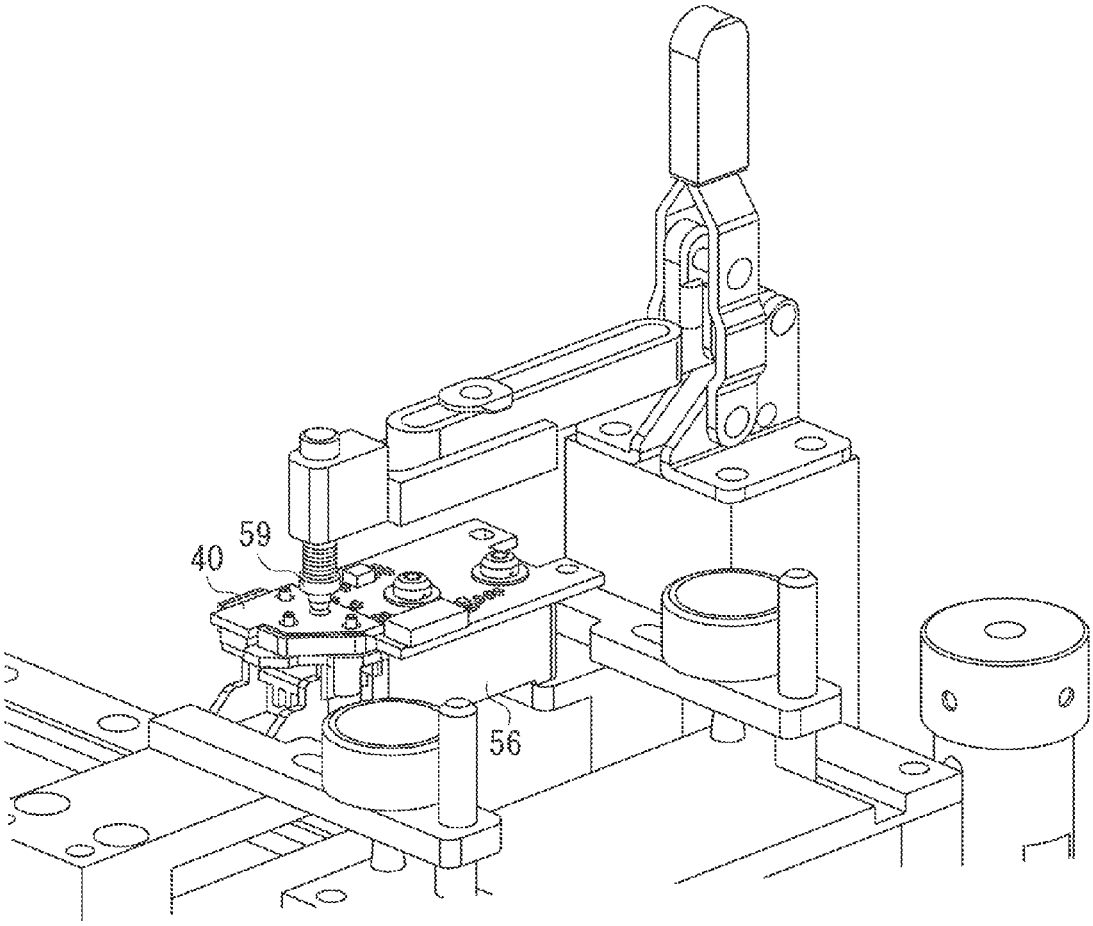
FIG. 4 is a schematic view of a tool when the optical sensor according to an exemplary embodiment of the present invention is assembled.
Figure 5:
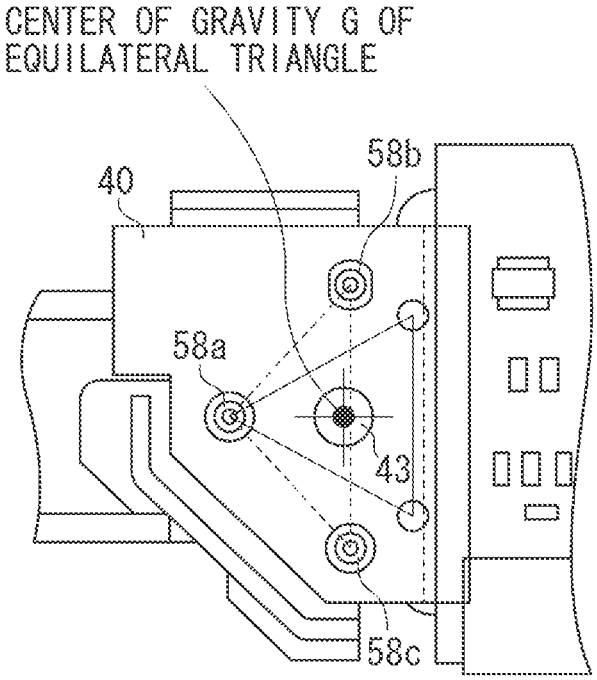
FIG. 5 is a schematic view illustrating a relationship between bonding points for fixing the LED board and an LED mounting position.

FIG. 7 is a view illustrating a state before the LED light-emitting unit 45 is attached, bonded, and fixed to the sensor frame 56. The adhesive is poured between protrusions 57*a*, 57*b*, and 57*c*, which are provided on the sensor frame 56, and holes provided in the LED board 40. Bonding portions 58*a*, 58*b*, and 58*c*, which become supporting portions at three points, are desirably located near the LED light-emitting unit 45 to reduce an effect of deformation of the LED board 40 due to heat or other causes. Therefore, the boding portions 58*a*, 58*b*, and 58*c* are provided at three places to distribute the effect of the deformation. In the LED light-emitting unit 45, to minimize the inclination of the optical axis, the cap lens 43 may be located at a position which becomes the center of gravity G of an equilateral triangle having apexes as the bonding portions 58*a*, 58*b*, and 58*c*, as illustrated in FIG. 5. This is because, since the present exemplary embodiment has a configuration in which the mounting surface 47 abuts against the abutting surface 49 of the sensor frame 56 to determine the position of the LED board 40 in the height direction, the inclination of the LED board 40 may occur according to the position of the mounting surface 47 with respect to the LED board 40. When the triangle of the bonding portions is an isosceles triangle, the cap lens 43 may be located as follows. As illustrated in FIG. 3, the cap lens 43 is located between the center of gravity G and the base B of the isosceles triangle, where the center of gravity G is on a line connecting an apex A and the center of gravity G (on a bisector of an apex A), so that the inclination of the optical axis can be avoided or minimized. Making the LED board 40 flat, the size of the LED board 40 can be reduced more. As illustrated in FIG. 4, when the sensor is assembled, a press member provided in an assembly tool presses the back side of the LED board 40 against the sensor frame 56, and the three bonding portions are simultaneously bonded. With this configuration, the inclination of the LED board 40 can be prevented by a force generated when the adhesive is solidified.

Further, in the registration patch detection sensor 50, to condense reflection light onto the light-receiving unit 53 without distortion, it is useful for an optical system to take the incident angle entering the lens 55B to be large, so that the LED light-emitting unit 45 and the photo IC 53 are located close to each other. The surface of the intermediate transfer belt 7 illuminated by light emitted from the LED light-emitting unit 45 slightly shifts (moves) with respect to the light-emitting unit 45 along the optical axis of the light. More specifically, the illuminated surface of the intermediate transfer belt 7 vibrates in the direction in which the light incident thereupon propagates. The reflection light detected by the photo IC 53 also varies due to the vibration of the illuminated surface. To make the variation of the reflection light small, it is useful to take a configuration which makes the positions of the LED light-emitting unit 45 and the photo IC 53 close to each other. Therefore, since the LED board 40 is required not to protrude on the PD board side as much as possible, the triangle having apexes as the bonding portions 58*a*, 58*b*, and 58*c* of the LED board 40 needs to be flat more as illustrated in FIG. 3. As described above, the relationship between the position of the LED relative to the LED board 40 and the bonding portions 58*a*, 58*b* and 58*c*, which fix the LED board 40 to the sensor frame 56, is important. With this configuration, the image forming apparatus of the present exemplary embodiment can increase reading accuracy, by using a compact sensor.

According to the configuration of the present exemplary embodiment, the force to an electrical circuit board can be reduced and the inclination of the optical axis of the light-emitting element can be small. The force is generated when the electrical circuit board having the light-emitting element thereon is attached to the sensor frame.

The present exemplary embodiment is described using the tandem type full color image forming apparatus having a plurality of photosensitive members located along the intermediate transfer belt. However, the present invention can be applied to a single drum type full color image forming apparatus capable of switching developing colors by using the intermediate transfer belt.

The present exemplary embodiment has a configuration for detecting a toner image on an intermediate transfer belt. However, the present invention is not limited to the intermediate transfer belt. The effect of the present invention can be obtained by using the configuration of the present invention as a sensor which detects a toner image formed on a transfer belt bearing a recording material or a toner image formed on a photosensitive drum.

In the present exemplary embodiment, the sensor is describe as a sensor for detecting color misregistration. However, the configuration of the present invention can be used as a sensor for detecting the density of a toner image, which can effectively increase a detection accuracy of the density of a toner image.

While the present invention has been described with reference to exemplary embodiments, it is to be understood that the invention is not limited to the disclosed exemplary embodiments. For example, the present invention has been described as being directed to an image forming apparatus including a sensor in which an inclination of an optical axis of a light-emitting element is minimized. However, the scope of the following claims is to be accorded the broadest interpretation so as to encompass all modifications, equivalent structures, and functions.

This application claims priority from Japanese Patent Application No. 2010-113564 filed May 17, 2010, which is hereby incorporated by reference herein in its entirety.

What is claimed is:

1. An image forming apparatus comprising:

an image bearing member;

a toner image forming unit configured to form a toner image on the image bearing member;

a sensor configured to detect the toner image formed on the image bearing member, the sensor including a light-emitting unit configured to include a light-emitting element for emitting light and to include a supporting board for supporting the light-emitting element, a light-receiving unit configured to receive reflected light, an electrical circuit board in which the light-emitting unit is attached, and a frame configured to include a positioning portion for abutting against the supporting board and for positioning the light-emitting unit relative to the frame and to support the electrical circuit board with the electrical circuit board bonded with three supporting portions; and a control unit configured to control a toner image forming condition of the toner image forming unit according to an output of the sensor.

2. The image forming apparatus according to claim 1, wherein the light-emitting unit is attached to the frame such that an optical axis of light emitted from the light-emitting unit is substantially orthogonal to a surface of the image bearing member illuminated with the light emitted from the light-emitting unit.

3. The image forming apparatus according to claim 1, wherein the three supporting portions are provided at the frame in such a manner as to form a triangle, and wherein the light-emitting unit is located on a bisector of an apex angle formed by two sides of equal length of the triangle.

4. The image forming apparatus according to claim 3, wherein the light-emitting unit is located on the bisector and farther from the apex than a center of gravity of the triangle.

5. The image forming apparatus according to claim 4, further comprising a light-receiving circuit board supporting the light-receiving unit, wherein the light-emitting unit is located closer to the light-receiving circuit board supporting the light-receiving unit than the center of gravity.

6. The image forming apparatus according to claim 3, wherein the triangle is an equilateral triangle or an isosceles triangle.

7. An image forming apparatus comprising:

an image bearing member;

a toner image forming unit configured to form a toner image on the image bearing member;

a sensor configured to detect the toner image formed on the image bearing member, the sensor including a light-emitting unit configured to include a light-emitting element for emitting light and to include a supporting board for supporting the light-emitting element, a light-receiving unit configured to receive reflected light, an electrical circuit board in which the light-emitting unit is attached, and a frame configured to include a positioning portion for abutting against the supporting board and for positioning the light-emitting unit relative to the frame; and a control unit configured to control a toner image forming condition of the toner image forming unit according to an output of the sensor.

8. The image forming apparatus according to claim 7, wherein the frame supports the electrical circuit board by bonding the electrical circuit to at least three supporting portions.

9. The image forming apparatus according to claim 7, wherein the frame supports the electrical circuit board by bonding the electrical circuit to three supporting portions.

10. The image forming apparatus according to claim 9, wherein the light-emitting unit is attached to the frame such that an optical axis of light emitted from the light-emitting unit is substantially orthogonal to a surface of the image bearing member illuminated with the light emitted from the light-emitting unit.

11. The image forming apparatus according to claim 9, wherein the three supporting portions are provided at the frame in such a manner as to form a triangle, and wherein the light-emitting unit is located on a bisector of an apex angle formed by two sides of equal length of the triangle.

12. The image forming apparatus according to claim 11, wherein the triangle is an equilateral triangle or an isosceles triangle.

13. The image forming apparatus according to claim 11, wherein the light-emitting unit is located on the bisector and farther from the apex than a center of gravity of the triangle.

14. The image forming apparatus according to claim 13, further comprising a light-receiving circuit board supporting the light-receiving unit, wherein the light-emitting unit is located closer to the light-receiving circuit board than the center of gravity.

* * * * *